US007625131B2

(12) United States Patent
Zienkewicz et al.

(10) Patent No.: US 7,625,131 B2
(45) Date of Patent: Dec. 1, 2009

(54) INTERFACE FOR WAVEGUIDE PIN LAUNCH

(75) Inventors: Rob Zienkewicz, Chandler, AZ (US); Dave Harper, Mesa, AZ (US); Kenneth V Buer, Gilbert, AZ (US); John DeCamp, Mesa, AZ (US)

(73) Assignee: Viasat, Inc., Carlsbad, CA (US)

( * ) Notice: Subject to any disclaimer, the term of this patent is extended or adjusted under 35 U.S.C. 154(b) by 0 days.

(21) Appl. No.: 11/743,496

(22) Filed: May 2, 2007

(65) Prior Publication Data

US 2008/0273843 A1 Nov. 6, 2008

(51) Int. Cl.
*G02B 6/36* (2006.01)

(52) U.S. Cl. ..... 385/88

(58) Field of Classification Search ..... 385/88
See application file for complete search history.

(56) References Cited

U.S. PATENT DOCUMENTS

| | | | | |
|---|---|---|---|---|
| 3,987,451 | A * | 10/1976 | Peterson | 343/765 |
| 4,608,713 | A | 8/1986 | Shiomi et al. | |
| 4,868,639 | A | 9/1989 | Mugiya et al. | |
| 4,947,111 | A * | 8/1990 | Higman et al. | 324/755 |
| 4,967,168 | A | 10/1990 | Bacher et al. | |
| 5,019,829 | A * | 5/1991 | Heckman et al. | 343/700 MS |
| 5,045,820 | A | 9/1991 | Leicht et al. | |
| 5,170,142 | A | 12/1992 | Bier | |
| 5,198,786 | A | 3/1993 | Russell et al. | |
| 5,218,373 | A | 6/1993 | Heckaman et al. | |
| 5,488,380 | A | 1/1996 | Harvey et al. | |
| 5,678,210 | A | 10/1997 | Hannah | |
| 5,945,894 | A | 8/1999 | Ishikawa et al. | |
| 5,969,580 | A | 10/1999 | Maillet et al. | |
| 6,232,849 | B1 | 5/2001 | Flynn et al. | |
| 6,363,605 | B1 | 4/2002 | Shih et al. | |
| 6,911,877 | B2 * | 6/2005 | Bickford | 333/33 |
| 2004/0038587 | A1 | 2/2004 | Yeung et al. | |
| 2005/0191869 | A1 | 9/2005 | Oldfield | |
| 2007/0096805 | A1 | 5/2007 | Kim et al. | |

FOREIGN PATENT DOCUMENTS

| | | |
|---|---|---|
| EP | 0954045 | 11/1999 |
| JP | 06-338709 | 12/1994 |
| WO | WO 03/084001 | 10/2003 |

OTHER PUBLICATIONS

International Search Report and Written Opinion from corresponding PCT application (PCT/US2008/062095) dated Aug. 8, 2008.

(Continued)

*Primary Examiner*—Frank G Font
*Assistant Examiner*—Mary A El Shammaa
(74) *Attorney, Agent, or Firm*—Snell & Wilmer L.L.P.

(57) ABSTRACT in general, in accordance with an exemplary aspect of the present invention, a low-loss interface for connecting an integrated circuit such as a monolithic microwave integrated circuit to an energy transmission device such as a waveguide is disclosed. In one exemplary embodiment, the interface comprises a pin seated within an assembly that forms a hermetic sealed, coaxial structure to prevent signal loss at increasing frequencies.

21 Claims, 3 Drawing Sheets

OTHER PUBLICATIONS

Office Action dated Jan. 5, 2009 for U.S. Appl. No. 11/874,369.
First Written Opinion of International PCT Application No. PCT/US2008/075969 dated Nov. 18, 2008.
International Preliminary Report on Patentability issued on May 20, 2009 in corresponding PCT Application No. PCT/US2008/062095.
Office Action for U.S. Appl. No. 11/874,369 dated Jun. 19, 2009.

* cited by examiner

INTERFACE FOR WAVEGUIDE PIN LAUNCH

FIELD OF INVENTION

The present invention generally relates to an interface for use, for example, between an integrated circuit and a waveguide. More particularly, the present invention relates to an interface comprised of a low-loss pin and pin assembly that transports signals from, for example, an integrated circuit, such as a monolithic microwave integrated circuit, to a waveguide.

BACKGROUND OF THE INVENTION

There are numerous circuits and other electronic devices that produce energy waves such as electromagnetic waves and microwaves. These circuits produce energy waves that are delivered to a destination through different wires, guides, and other mediums.

Energy waves can be difficult to control on various circuits, cables, wires, and other mediums that transport the energy waves because these mediums are "lossy." Lossy materials and mediums loose energy by radiation, attenuation, or dissipation as heat. By being lossy, a portion of the signal is lost as is travels through the circuits, wires, and other mediums. Stated another way, a signal entering a lossy material will be greater at the point of entry than at the point of exit.

Microwave energy is particularly difficult to control as many of the materials and mediums that transport microwave energy are lossy. One exemplary circuit that generates and transports microwaves is a "monolithic microwave integrated circuit" or "MMIC." Lost signal waves are unusable and decrease the efficiency of a MMIC as the signal strength decreases due to loss. Generally, the higher the frequency of the microwave, the more lossy the transmission medium and more inefficient the circuit. In certain applications, even signal losses that reduce the signal small amounts, such as 1/10 of a decibel, may result in a significant performance loss. One exemplary application where loss from energy waves such as microwaves is problematic is a power amplifier.

One structure used to reduce lossiness is a waveguide. Waveguides are structures that guide energy waves with minimal signal loss. Unfortunately, signal loss is still problematic with certain waves because the connection or interface between the circuit generating the energy waves and the waveguide can be lossy itself. This is especially an obstacle with a MMIC generating microwaves. Moreover, impedance mismatches also cause signal losses. For example, the impedance of the MMIC, for example fifty ohms, may not match the impedance of the connected waveguide, for example two hundred and seventy ohms. In this example, an interface between the waveguide and MMIC attempts to match the fifty ohm impedance of the MMIC with the two hundred and seventy ohm impedance of the waveguide. These types of interfaces are known generally as "impedance matching interfaces" or "impedance matching and transforming interfaces." Throughout, the term "interface" is meant to denote an "impedance matching interface" or "impedance matching and transforming interface."

Current interfaces between a MMIC and waveguide comprise numerous structures that include wirebonds, microstrips, pins, and other devices to connect a circuit to a waveguide or another structure. These interfaces also attempt to match and transform the impedance of the MMIC to the impedance at the waveguide. However, current impendence matching interfaces between an integrated circuit such as a MMIC and a waveguide still have an unacceptable amount of loss.

Therefore, it would be advantageous to provide an interface between an integrated circuit, such as a MMIC, and a waveguide, or other structure that reduces signal loss. It would also be advantageous to produce an interface that reduced loss that was inexpensive and easy to manufacture, particularly one that was constructed from parts that were commercially available.

SUMMARY OF THE INVENTION

In general, in accordance with one exemplary aspect of the present invention, an interface for connecting an integrated circuit such as a MMIC to a waveguide is provided. In one exemplary embodiment, the interface comprises a pin placed within an assembly which is configured to reduce signal loss. In another aspect of the present invention, two or more beads connect the pin to the assembly to further define the space. In yet another aspect of one exemplary embodiment, one bead is formed from glass to form a hermetic seal and the interface is connected to the integrated circuit.

BRIEF DESCRIPTION OF THE DRAWING

A more complete understanding of the present invention may be derived by referring to the detailed description and claims when considered in connection with the Figures, where like reference numbers refer to similar elements throughout the Figures, and:

DETAILED DESCRIPTION OF EXEMPLARY EMBODIMENTS OF THE INVENTION

In accordance with one aspect of the present invention, an interface for connecting an integrated circuit to an energy transmission device such as a waveguide is disclosed. In accordance with another aspect of the present invention, a method of manufacturing an interface is disclosed. Throughout, the interface will be referred to as interface 10.

Figure 1:
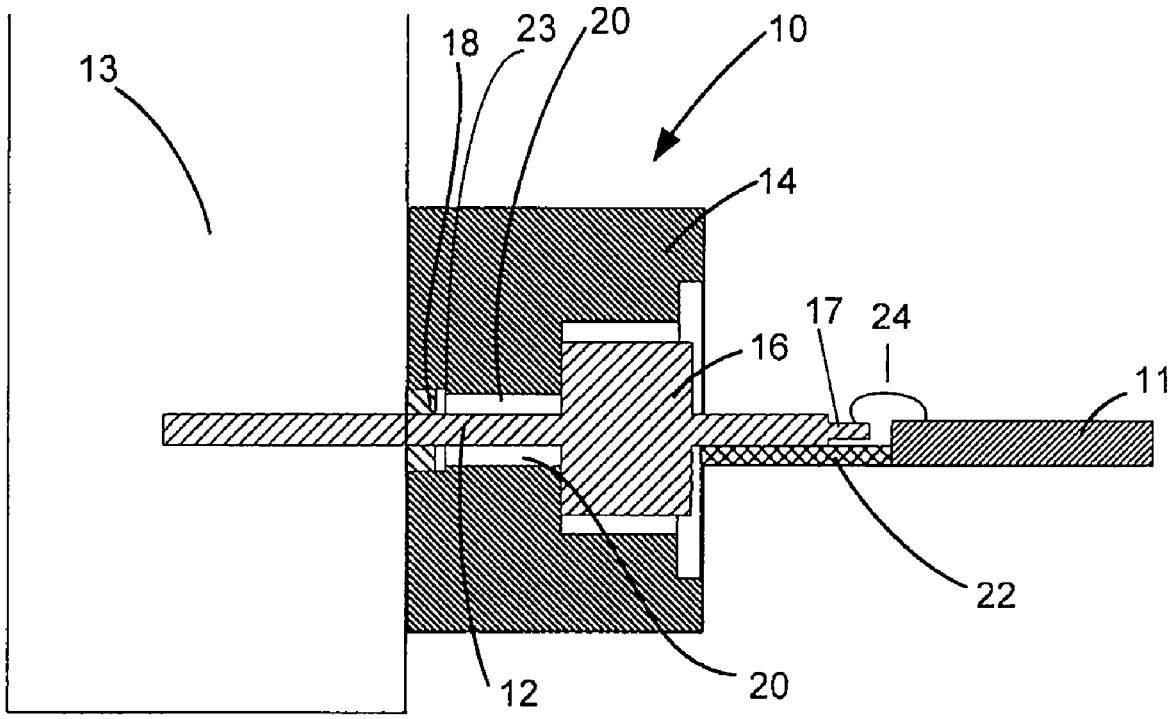
FIG. 1 illustrates an exemplary schematic diagram of the interface in accordance with an exemplary embodiment of the present invention.
Figure 2:
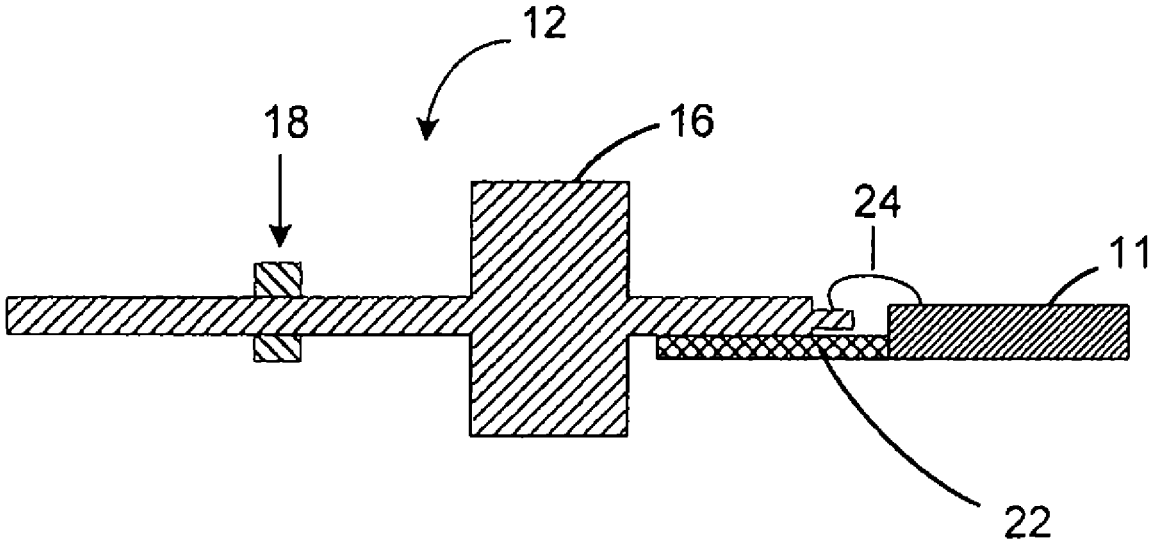
FIG. 2 illustrates an exemplary schematic diagram of the pin and beads apart from the assembly in accordance with an exemplary embodiment of the present invention.
Figure 3:
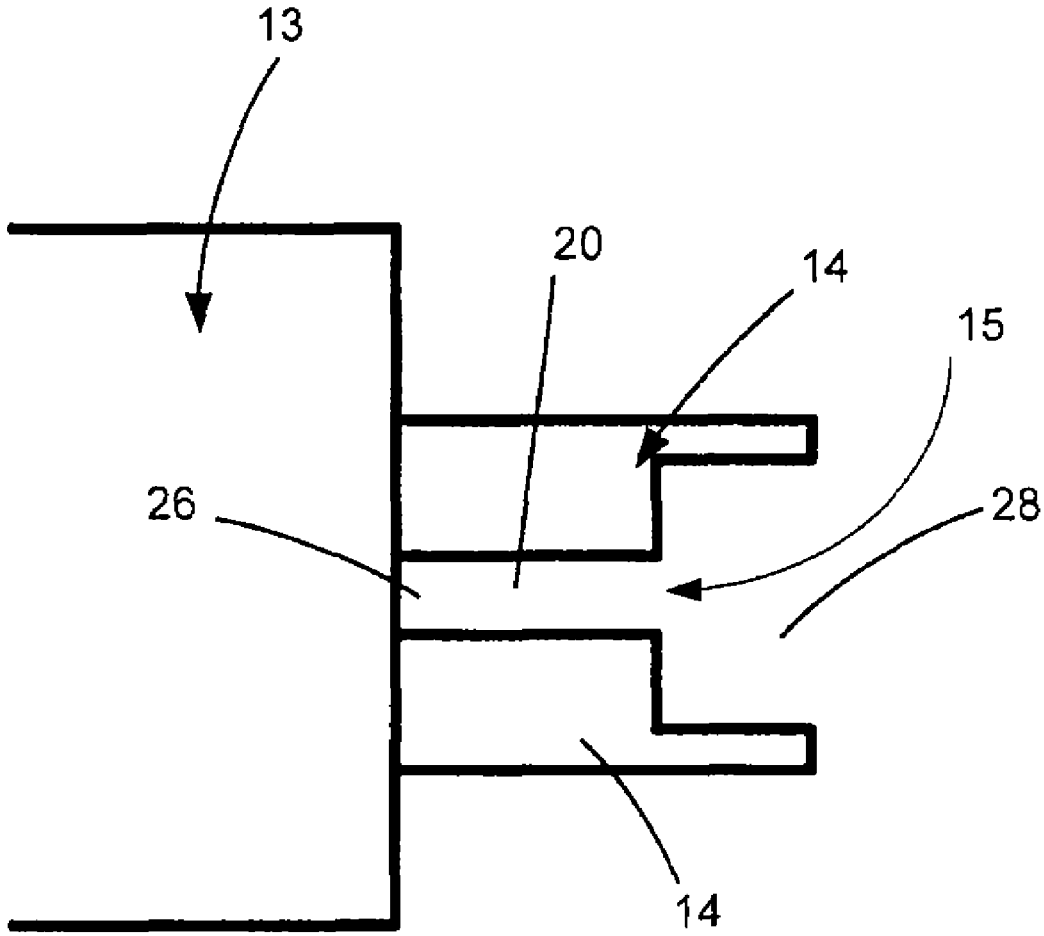
FIG. 3 illustrates an exemplary schematic diagram of the assembly apart from the pin and beads in accordance with an exemplary embodiment of the present invention.

With reference to FIGS. 1-3, and in accordance with an exemplary embodiment of the present invention, interface 10 is a low-loss interface comprising a coaxial structure that is configured to transmit energy from one device to another. It should be noted that the term "low-loss" refers to the ability to reduce signal loss as discussed above. In an exemplary embodiment, interface 10 connects an integrated circuit 11 to another energy transmission device 13 and matches the impedance at integrated circuit 11 to the impedance at energy transmission device 13. Furthermore, interface 10 can be any device configured to transmit energy and match impedance between two or more energy producing or transmission devices.

In one exemplary embodiment, circuit 11 is a monolithic microwave integrated circuit (MMIC). In another exemplary embodiment, circuit 11 comprises discrete components on a circuit board such as memory devices, power sources, light emitting diodes, and the like. Circuit 11 can be any type of circuit, circuit board, printed circuit board, integrated circuit, or other type of device or medium that produces or transfers energy waves. As such, the term "circuit" is not limited to devices with discrete components on a circuit board but rather includes any device that produces or transmits energy waves such as wires, cables, or waveguides. Similarly, energy transmission device 13 can be any type of device or medium configured to produce or transport energy. In one exemplary embodiment, energy transmission device 13 is a waveguide that guides microwave energy waves. In another exemplary embodiment, energy transmission device 13 comprises wires, cables or other devices configured to transport and guide energy waves from one source to another.

In one exemplary embodiment, interface 10 is a coaxial structure comprising a pin 12 that contacts circuit 11 on one end and energy transmission device 13 on the other end. Pin 12 is disposed within an assembly 14. A set of beads 16, 18 contact pin 12 and assembly 14 and further define a space 20 between pin 12 and assembly 14 which helps impart the coaxial structure to interface 10. In one exemplary embodiment, an insulator 22 contacts pin 12 and circuit 11 and a wire connector 24 connects pin 12 to circuit 11.

Pin 12 is a low-loss pin comprising a low-loss conductive medium. In an exemplary embodiment, pin 12 is a feedthru pin, such as a microwave feedthru pin comprising a low-loss conductive material. In one exemplary embodiment, pin 12 comprises two ends with one end configured to be connected to energy transmission device 13 and the other opposing end connected to circuit 11. Pin 12 can be connected to circuit 11 and energy transmission device 13 by mere contact without adhesives or the like or it can be connected by an adhesive, soldering, or attachment devices such as pins and screws. In one exemplary embodiment, pin 12 is configured to be connected to circuit 11 by wire connector 24.

In one exemplary embodiment, pin 12 is a relatively long, narrow member that is round. Other shapes of pin 12 in other exemplary embodiments of the present invention comprise an oval, square, rectangular shaped, irregularly shaped or the like. In one exemplary embodiment, pin 12 is one continuous shape from one end to the other. However, in other exemplary embodiments, half of pin 12 can be round while the other half is another shape (such as an oval) resulting in pin 12 having two shaped regions. Numerous different shaped regions can be located along pin 12.

With reference to FIGS. 1-2, and in one exemplary embodiment, one end of pin 12 can be tapered and rests on insulator 22. In this exemplary embodiment, pin 12 is configured to have a flat portion 17 configured to receive wire connector 24, e.g. a bond wire. Further, flat portion 17 may be prepared with an ohmic material for forming a better connection with wire connector 24. In other exemplary embodiments, the end of pin 12 can be non-tapered and have the same radius as the rest of pin 12. In other exemplary embodiments, the end of pin 12 that contacts insulator 22 can be larger than the remaining portion of pin 12.

Furthermore, pin 12 can be any length or radius. In accordance with one aspect of the present invention, the length and radius of pin 12 are selected based on the impedance of pin 12 and energy transmission device 13. Further, the length and radius of pin 12 may depend on the frequency of the energy being transmitted, or the physical properties (size and overall dimensions) of pin 12 and energy transmission device 13. In one exemplary embodiment, where the impedance at circuit 11 is fifty ohms, pin 12 has a radius of 0.086 inches. Any other radius of pin 12 configured to facilitate impedance matching, appropriate for the frequency of the energy traveling through pin 12, and physically appropriate to match the physical properties of circuit 11 and energy transmission device 13 can be used and fall within the scope of the present invention.

In one exemplary embodiment, pin 12 comprises or is formed of a single conductive metal. For example, pin 12 may be solid gold, silver, copper, and/or other similar materials with low resistance. Furthermore, the conductive material may be any material configured to conduct the energy being transmitted through pin 12.

In another exemplary embodiment, pin 12 comprises a core formed from a rigid material and the core is coated (or partially coated) with a conductive material. For example, pin 12 may comprise a rigid material such as a Kovar® alloy produced by the Westinghouse Electric and Manufacturing Company of Pittsburgh, Pa. The rigid alloy gives pin 12 strength and is coated with conductive materials such as gold, silver, or copper which is configured to conduct energy along pin 12. Furthermore, any rigid material (certain exemplary materials, include, but are certainly not limited to, metal, alloy, or plastic) configured to impart strength to pin 12 and/or configured to be plated or coated in a conductive material can be used. The conductive material may be the same as described above in the single conductive material embodiment.

Pin 12 can be custom manufactured or it can be a commercially available feedthru pin that is easily available to the public. In an exemplary embodiment, pin 12 is a microwave feedthru pin that is commercially available from numerous sources including Special Hermetic Products, Inc. of Wilton, N.H., Thunderline Z (a division of Emerson, Inc.) of Hampstead, N.H. or Tyco Electronics of Wilmington, Del.

In accordance with an exemplary embodiment of the present invention, pin 12 is disposed within assembly 14. In one exemplary embodiment, assembly 14 comprises a metal core that is coated with a low-loss metal. In another exemplary embodiment, assembly 14 comprises a plastic or an alloy to impart strength to assembly 14 that is covered in a low-loss metal. Certain exemplary low-loss metals are silver, gold, and copper. An exemplary alloy is a Kovar® alloy which is covered or coated with a low-loss material.

Assembly 14 can comprise a single piece of material or it can comprise two or more pieces of material. In one exemplary embodiment, assembly 14 comprises a metal block that has been drilled out to form a space 15. In another exemplary embodiment, assembly 14 is formed from two or more pieces of conductive material that are joined together by welding, soldering, or other connectors such as screws, bolts, pins or adhesives. In other exemplary embodiments, any materials configured to facilitate impedance matching and reduce signal loss can be used to construct assembly 14.

With reference now to FIG. 3, in accordance with an exemplary embodiment, assembly 14 comprises two openings. One opening 26 may be smaller and configured to be disposed next to energy transmission device 13. The other opening 28 may be larger and configured to be located next to circuit 11. As is explained below, openings 26 and 28 help define space 20 together with pin 12 and beads 16, 18. The size of opening 26 may be selected based on various factors such as (but not limited to) the size of pin 12, the size of space 20 desired, the size of bead 18, and to facilitate impedance matching and to reduce loss. The diameter of opening 28 may be selected based on various factors such as (but not limited to) the size of pin 12, the size and related depth of energy transmission device 13, the size of bead 16, and to facilitate impedance matching and reduce loss.

Beads 16 and 18 are disposed within and contact assembly 14. Each bead 16, 18 further comprises a center hole or other opening which enables beads 16, 18 to slide onto and concentrically surround pin 12. Similar to openings 26 and 28, the diameter of beads 16, 18 varies depending on the application interface 10 is used for and various other factors such as (but not limited to) the size of pin 12, and the size of space 20. Beads 16, 18 create space 20 when they are attached to pin 12 and disposed within assembly 14. In one exemplary embodiment, bead 16 is larger than bead 18.

In one exemplary embodiment, bead 16 is the larger of the two beads and comprises a non-conductive material such as glass. In other exemplary embodiments, bead 16 comprises a Teflon® material produced by the E.I. DuPont De Nemours Company of Wilmington, Del. In other exemplary embodiments, bead 16 comprises non-conductive plastics, metals, or alloys. Any non-conductive material now known or developed in the future can be used for beads 16, 18 and fall within the scope of the present invention.

As depicted in this exemplary embodiment, bead 18 is smaller than bead 16 and is placed adjacent to energy transmission device 13. Bead 18 is used to secure pin 12 within assembly 14 and hold it in place in an exemplary embodiment. In other exemplary embodiments, bead 18 can be eliminated. As noted herein, in one exemplary embodiment, bead 18 comprises a Teflon® material. Further, as depicted, a notch 23 is defined within assembly 14 to allow bead 16 to fit completely within assembly 14 and not slide into energy transmission device 13. In other exemplary embodiments, notch 23 is eliminated and bead 18 is completely flush with the edge of assembly 14. In other exemplary embodiments, bead 18 protrudes from assembly 14 into energy transmission device 13.

In an exemplary embodiment, interface 10 is configured to form a hermetic seal between the space containing energy transmission device 13 and the space containing circuit 11. This seal is formed by sealing bead 16 to assembly 14. This hermetic seal prevents water, dust, air, and other pollutants from entering space 20.

As noted above, pin 12 and assembly 14 define space 20 which is further defined by beads 16, 18. Space 20 further reduces signal loss from interface 10. As depicted, space 20 concentrically surrounds pin 12 and extends from bead 16 to bead 18 in one exemplary embodiment. The size of space 20 is directly related to application interface 10 is used depending on the frequency of the energy being transmitted, and the impedance of circuit and energy transmission device 13. The size of space 20 can also be directly related to physical properties of circuit 11 and energy transmission device 13 similarly to the size of beads 16, 18 and their respective openings 26, 28.

In one exemplary embodiment, one end of pin 12 rests on insulator 22. Insulator 22 can comprise any type of insulating material and can be any size. However, in one exemplary embodiment, insulator 22 is a thin insulator comprising a piece of insulating tape. In another exemplary embodiment, insulator 22 comprises a thin layer of liquid epoxy which has insulating properties. Further, in these exemplary embodiments, insulator 22 is two thousandths of an inch or smaller. In other exemplary embodiments, other insulators of various sizes and constructions are used and still fall within the scope of the present invention. Insulator 22 may be configured to prevent pin 12 from bending. Furthermore, insulator 22 may comprise material that is configured to separate pin 12 from the environment.

In one exemplary embodiment, wire connector 24 further connects interface 10 to circuit 11. In certain exemplary embodiments, wire connector 24 is a wire bond connector comprising gold, aluminum, copper or a combination of two or more of these metals. Further, wire connector 24 is attached to flat edge 17 of pin 12. Certain exemplary types of wire bonds comprise, but are not limited to, ball bonds and wedge bonds. In other exemplary embodiments, other metals or materials are used to construct wire connector 24.

An exemplary method of manufacturing interface 10 will now be discussed. While specific materials and techniques are mentioned herein, other materials, parts, supplies, and techniques can certainly be used to manufacture interface 10 and fall within the scope of the present invention.

This exemplary method of manufacturing interface 10 first comprises the step of producing assembly 14. Assembly 14 comprises a metal block covered with another low-loss material such as a metal or alloy. In other exemplary embodiments assembly 14 is a metal block which is non-coated and constructed entirely from a low-loss material. The metal block is drilled out creating a cavity which forms space 15. In another exemplary embodiment, assembly 14 comprises two or more pieces of material that are attached together as described above. The size of space 15 is determined based on the application that interface 10 will be used for.

Part of the manufacturing process in this exemplary embodiment involves the assembly of pin 12. In this exemplary embodiment, pin 12 is an off-the-shelf RF feedthru pin such as a microwave feedthru pin that is commercially available from numerous sources as noted above. In other exemplary embodiments, pin 12 is custom manufactured and not an off-the-shelf pin. As noted above pin 12 comprises a solid piece of conductive material. In other exemplary embodiments, pin 12 comprises a rigid core coated or plated with a conductive material. The size of pin 12 is determined based on the application that interface 10 will be used for.

Before pin 12 is placed within assembly 14, bead 16 is placed around pin 12. Bead 16 may be placed around pin 12 in one exemplary embodiment or pin 12 may be manufactured with bead 16 already attached to pin 12. As noted above, bead 16 may comprise a low-loss material such as glass or a Teflon® material. A hole is placed through bead 16 which is slightly larger than the radius of pin 12. Bead 16 is then slid onto pin 12 and concentrically surrounds pin 12.

Pin 12 and bead 16 are then placed within assembly 14. Once pin 12 and bead 16 are placed within assembly 14, bead 18 is placed around pin 12. As noted above, bead 18 may comprise a low-loss material such as a glass or a Teflon® material. A hole is placed through bead 18 which is slightly smaller than the radius of pin 12. Bead 18 can still be slid onto pin 12 because, in one exemplary embodiment, bead 18 is made from a pliable material.

Further, in one exemplary embodiment, beads 16, 18 are attached to the assembly 14 to create a hermetic seal at one or both ends of the assembly 14. This hermetic seal helps reduce loss in an exemplary embodiment. The exact spacing around pin 12 and beads 16, 18 can vary. Bead 18 is completely flush within the cavity and seated directly against assembly 14. In other exemplary embodiments, there is no space around either bead 16, 18 and pin 12 and beads 16, 18 are firmly seated within space 15.

The next step in this exemplary manufacturing process is to connect pin 12 to insulator 22. In one exemplary embodiment, pin 12 is merely placed on and not attached to insulator 22 to prevent pin 12 from bending. In other exemplary embodiments, pin 12 is attached to insulator 22 by adhesives. Pin 12 is also connected to circuit 11 by wire connector 24. In one exemplary embodiment, wire connector 24 is a wire bond between interface 10 and circuit 11 and is attached by wire bonding techniques. Further, any number of wires or other connector members can be used as wire connector 24 and fall within the scope of the present invention.

Once the manufacturing process of interface 10 is complete, interface 10 is configured to deliver energy waves such as microwaves from circuit 11 to energy transmission device 13. In one exemplary embodiment, circuit 11 is a MMIC and energy transmission device 13 is a waveguide. Further, interface 10 is configured to be an impedance matching device and loose little energy and signal even as the frequency of the energy and signal is increased.

While the principles of the invention have now been made clear in illustrative embodiments, there will be immediately obvious to those skilled in the art many modifications of structure, arrangements, proportions, the elements, materials and components, used in the practice of the invention which are particularly adapted for a specific environment and operating requirements without departing from those principles. These and other changes or modifications are intended to be included within the scope of the present invention, as expressed in the following claims.

What is claimed is:

1. An interface comprising:

a pin configured to transport energy from a monolithic microwave integrated circuit to a waveguide; an assembly surrounding the pin configured to reduce energy loss as compared to a pin without the assembly surrounding the pin; wherein one end of the pin is disposed within the assembly and an opposing end of the pin is disposed within the waveguide;

a wire connector directly connected to the monolithic microwave integrated circuit on one end and directly connected to the opposing end of the pin disposed within the assembly;

a space defined between the pin and the assembly;

wherein size of the space and size of the pin are selected to facilitate impedance transformation along the interface in order that the energy will experience a similar impedance at an end of the interface near the monolithic microwave integrated circuit as the energy experiences on the monolithic microwave integrated circuit and also experience a similar impedance at an opposing end of the interface near the waveguide as the energy experiences in the waveguide.

2. The interface of claim 1, further comprising two beads that are connected to the assembly that further define the space wherein one bead is located on one end of the assembly near the monolithic microwave integrated circuit and the other bead is located on the opposing end of the assembly near the waveguide and the two beads help form a hermetic seal for the space.

3. The interface of claim 1, further comprising an insulator attached to the pin.

4. The interface of claim 1, wherein the interface comprises two opposing ends, wherein one end is attached to the monolithic microwave integrated circuit and the other end is attached to a waveguide, and further comprising a hermetic seal between the monolithic microwave integrated circuit and the waveguide.

5. An interface comprising:

a pin comprising first and second ends, wherein the first end is connected to a waveguide assembly and the other end is directly connected to a circuit by a wirebond, wherein the pin is configured to transport energy between the circuit and the waveguide;

an assembly with two opposing ends surrounding the pin and connected to the waveguide wherein the assembly is configured to reduce energy loss;

two non-conductive support members contacting the pin and the assembly wherein one non-conductive support member contacts one end of the assembly adjacent to the waveguide and the other non-conductive support member contacts the opposing end of the assembly;

a space defined by the pin, the assembly, and the two non-conductive support members;

wherein size of the space, size of the pin, and size of the two non-conductive support members are selected to facilitate impedance transformation along the interface.

6. The interface of claim 5, wherein the circuit is a monolithic microwave integrated circuit.

7. The interface of claim 5, wherein the non-conductive support member contacting the opposing end of the assembly from the waveguide forms a hermetic seal between the assembly and the pin.

8. The interface of claim 5, wherein the interface has a coaxial structure.

9. The interface of claim 5, further comprising an insulator attached to the pin adjacent to the circuit.

10. The interface of claim 9, wherein the insulator is tape.

11. The interface of claim 5, wherein the pin is a commercially available feedthru pin.

12. The interface of claim 5, wherein the interface further comprises a hermetic seal between the circuit and the waveguide assembly.

13. An interface comprising:

a feedthru pin with one end connected to a waveguide and another end directly connected to a monolithic microwave integrated circuit with a wire connector wherein the feedthru pin is configured to transport energy between the monolithic microwave integrated circuit and the waveguide;

an assembly surrounding the pin and connected to the waveguide wherein the assembly is configured to reduce energy loss;

a space concentrically surrounding the feedthru pin defined by the feedthru pin and the assembly; and a thin insulator attached to the pin adjacent to the monolithic microwave integrated circuit.

14. The interface of claim 13, wherein the wire connector is a wire bond.

15. The interface of claim 13, wherein the interface is a coaxial structure.

16. The interface of claim 13, wherein the space has a radius of 0.086 inches and the interface is configured for a fifty ohm feedthru pin.

17. The interface of claim 13, wherein the assembly comprises metal coated with a low-loss metal coating.

18. The interface of claim 13, wherein the assembly comprises plastic coated with a low-loss material.

19. The interface of claim 13, wherein the feedthru pin is comprised substantially of gold.

20. The interface of claim 13, wherein the interface further comprises a hermetic seal between the monolithic microwave integrated circuit and the waveguide assembly.

21. A low loss impedance interface configured to facilitate microwave signal transmission from a monolithic microwave integrated circuit to a waveguide, wherein the interface comprises:

a pin having a first end in communication with the waveguide to the pin, the pin further comprising a second end directly connected to the monolithic microwave integrated circuit via a wirebond;

an assembly comprising a low-loss material configured to surround the pin;

a space defined between the pin and the assembly;

wherein size of the space and size of the pin are selected to facilitate impedance transformation along the interface in order that the energy will experience a similar impedance at an end of the interface near the monolithic microwave integrated circuit as the energy experiences on the monolithic microwave integrated circuit and also experience a similar impedance at an opposing end of the interface near the waveguide as the energy experiences on the waveguide.

* * * * *